US010096919B2

(12) United States Patent
Ishida et al.

(10) Patent No.: US 10,096,919 B2
(45) Date of Patent: Oct. 9, 2018

(54) CARD EDGE CONNECTOR WITH TERMINAL FITTING CONFIGURED TO PIVOT IN A HOUSING IN RESPONSE TO DIFFERENTIAL THERMAL EXPANSION FOR AVOIDING ABRASION OF CONTACT PORTION OF TERMINAL FITTING

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hidetoshi Ishida, Mie (JP); Masanori Moriyasu, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 15/559,923

(22) PCT Filed: Mar. 10, 2016

(86) PCT No.: PCT/JP2016/057493
§ 371 (c)(1),
(2) Date: Sep. 20, 2017

(87) PCT Pub. No.: WO2016/158280
PCT Pub. Date: Oct. 6, 2016

(65) Prior Publication Data

US 2018/0097303 A1 Apr. 5, 2018

(30) Foreign Application Priority Data

Mar. 31, 2015 (JP) ..... 2015-072131

(51) Int. Cl.
*H01R 11/22* (2006.01)
*H01R 12/72* (2011.01)
(Continued)

(52) U.S. Cl.
CPC ..... *H01R 12/72* (2013.01); *H01R 12/91* (2013.01); *H01R 13/11* (2013.01); *H01R 13/40* (2013.01); *H01R 12/69* (2013.01); *H01R 12/81* (2013.01)

(58) Field of Classification Search
CPC ..... H01R 12/81; H01R 12/69
(Continued)

(56) References Cited

U.S. PATENT DOCUMENTS 5,624,283 A 4/1997 Hotea

FOREIGN PATENT DOCUMENTS

JP 8-45606 2/1996
JP 2008-91047 4/2008
(Continued)

OTHER PUBLICATIONS

International Search Report dated May 24, 2016.

*Primary Examiner* — Abdullah Riyami
*Assistant Examiner* — Justin Kratt
(74) *Attorney, Agent, or Firm* — Gerald E. Hespos; Michael J. Porco; Matthew T. Hespos

(57) ABSTRACT

It is aimed to avoid the abrasion of a contact portion of a terminal fitting. When a harness-side housing (4) is connected to a board-side housing (1), a contact portion (12) of a terminal fitting (3) resiliently contacts a circuit board (2), whereas a body portion (5) of the terminal fitting (3) is pressed against a ceiling wall (19) of a cavity (14). The body portion (5) is formed with a projecting edge (13). When there is a thermal expansion difference in an arrangement direction of the cavities (14) between the circuit board (2)
(Continued)

and the harness-side housing (4), the terminal fitting (3) pivots with a resilient abutting part of the contact portion (12) and the circuit board (2) serving as a supporting point.

8 Claims, 8 Drawing Sheets

(51) Int. Cl.

| | |
|---|---|
| ***H01R 13/40*** | (2006.01) |
| ***H01R 13/11*** | (2006.01) |
| ***H01R 12/91*** | (2011.01) |
| *H01R 12/81* | (2011.01) |
| *H01R 12/69* | (2011.01) |

(58) Field of Classification Search
USPC ..... 439/629, 852
See application file for complete search history.

(56) References Cited

FOREIGN PATENT DOCUMENTS

| | | | |
|---|---|---|---|
| JP | 2008091047 A | * | 4/2008 |
| JP | 2013-225442 | | 10/2013 |
| JP | 2014-238942 | | 12/2014 |

* cited by examiner

CARD EDGE CONNECTOR WITH TERMINAL FITTING CONFIGURED TO PIVOT IN A HOUSING IN RESPONSE TO DIFFERENTIAL THERMAL EXPANSION FOR AVOIDING ABRASION OF CONTACT PORTION OF TERMINAL FITTING

BACKGROUND

Field of the Invention

The invention relates to a card edge connector.

Description of the Related Art

Japanese Unexamined Patent Publication No. 2008-091047 discloses a card edge connector with a harness-side connector in which terminal fittings are arranged side by side in a harness-side housing and a board-side connector having a circuit board mounted in a board-side housing. The terminal fittings are accommodated respectively in cavities provided in the harness-side housing. When the housings are connected, a contact portion of each terminal fitting resiliently contacts a corresponding conductive path of the circuit board. Further, the terminal fitting is pressed against an opposite wall surface (ceiling surface) in the cavity by receiving a resilient reaction force at this time.

PBT resin (polybutylene terephthalate) and epoxy resin containing glass are used widely as a material of the harness-side housing and a material of the circuit board respectively. A linear expansion coefficient of the PBT resin is roughly 100 ppm/C.°, whereas a thermal expansion coefficient of the epoxy resin containing glass is roughly 10 to 15 ppm/° C. Thus, the harness-side housing and the circuit board have very different thermal expansion coefficients.

FIG. 9(B) herein illustrates the case of installing a prior art card edge connector in a high-temperature environment, such as an engine compartment. As shown in FIG. 9(B), a shift force P acts along an arrangement direction of terminal fittings 32 between a ceiling surface 31A of a cavity 31 in a connector housing 30 and the terminal fitting 32. Thus, the entire terminal fitting 32 slides on a circuit board 33 (state shown by a virtual line of FIG. 9(B)) and a contact portion 34 of the terminal fitting 32 may be rubbed and abraded.

The invention was completed based on the above situation and aims to provide a card edge connector capable of avoiding the abrasion of a contact portion of a terminal fitting due to a thermal expansion difference between a harness-side housing and a circuit board.

SUMMARY

The invention is directed to a card edge connector assembly with terminal fittings each including a body and a resilient tongue continuously formed in the body. The resilient tongue has a contact portion that is deflectable while projecting out from the body. The card edge connector assembly also includes a harness-side connector with a harness-side housing. The terminal fittings are accommodated in cavities formed side by side in the harness-side housing. The assembly further includes a board-side connector with a board-side housing configured so that a circuit board can be mounted in the board-side housing. The contact portion resiliently contacts the circuit board when the harness-side housing is connected to the board-side housing. Thus, a part of the body on an opposite side in a deflection direction of the resilient tongue serves as an abutting part to be pressed into contact with an inner wall of the cavity. One of the body and the inner wall of the cavity is formed with an escaping portion with respect to the inner wall of the cavity formed laterally to the abutting part in an arrangement direction of the cavities so that the terminal fitting pivots with a resilient abutting part of the contact portion and the circuit board serving as a suppor when there is a thermal expansion difference in the arrangement direction of the cavities between the circuit board and the harness-side housing.

According to the invention, if there is a thermal expansion difference in the arrangement direction of the cavities between the circuit board and the harness-side housing in a state where the harness-side connector and the board-side connector are connected, a shift force relatively acts along the arrangement direction of the cavities on the abutting part, where the terminal fitting is in contact with the inner wall of the cavity, from the inner wall of the cavity. By receiving this shift force, the terminal fitting is going to be displaced in a direction of action of the shift force. However, since the escaping portion is formed laterally to the abutting part of the inner wall of the cavity and the terminal fitting, the terminal fitting can pivot with the contact portion serving as a supporting point not accompanied by a displacement with respect to the circuit board. That is, since there is no relative movement between the contact portion and the circuit board, the abrasion of the contact portion can be avoided.

The abutting part may be disposed in a central part of the body in the arrangement direction of the cavities and the escaping portions may be disposed on both sides across the abutting part. According to this configuration, since the escaping portions are disposed on the both sides across the abutting part, the terminal fitting can pivot in both clockwise and counterclockwise directions with the contact portion serving as the support.

A projecting edge may project on the body of the terminal fitting. The projecting edge may have a pointed tip that functions as the abutting part and that is configured to resiliently contact the inner wall of the cavity along a direction perpendicular to the arrangement direction of the cavities. According to this configuration, the escaping portion can be ensured laterally to the projecting edge by forming the projecting edge on the terminal fitting. Further, since the projecting edge has a pointed tip, a projecting edge part can be displaced smoothly with respect to the cavity by reducing a contact area with the cavity. Furthermore, by forming the projecting edge only on the terminal fitting, the harness-side housing having an existing structure can be used.

A ridge may project on an inner wall of the cavity and may extend along a direction perpendicular to the arrangement direction of the cavities. The ridge may have a pointed tip, and the tip of the ridge may come into contact with the terminal fitting at the abutting part. According to this configuration, the escaping portion can be secured laterally to the ridge by forming the ridge serving as the abutting part on the inner wall of the cavity. Further, since the ridge has a pointed tip, a ridge part can be displaced smoothly by reducing a contact area with the terminal fitting. Furthermore, by forming the ridge only on the cavity, the terminal fitting having an existing structure can be used.

A recessed edge may be formed on the inner wall of the cavity. The recessed edge may have a chevron cross-section, recessed with a gentler gradient than side surfaces constituting the projecting edge and may be configured to contact the projecting edge along a longitudinal direction. According to this configuration, the escaping portions are formed at both widthwise sides of the projecting edge serving as the abutting part due to a gradient difference between the projecting edge and the recessed edge. Thus, the terminal fitting can be allowed to pivot at the time of thermal expansion. Further, by fitting the projecting edge and the recessed edge, there is also obtained an effect that the terminal fitting can be positioned in a width direction in the cavity.

A groove may be formed on the body of the terminal fitting. The groove may be recessed with a gentler gradient than side surfaces constituting the ridge and may have a trough part configured to contact the ridge along a longitudinal direction. According to this configuration, the escaping portions are formed at both widthwise sides of the trough of the groove serving as the abutting part due to a gradient difference between the ridge and the trough of the groove. Thus, the terminal fitting can be allowed to pivot at the time of thermal expansion. Further, there is also obtained an effect that the terminal fitting can be positioned in the width direction in the cavity since the ridge and the groove are fit along the longitudinal direction.

DETAILED DESCRIPTION

Next, a first specific embodiment of a card edge connector of the present invention is described with reference to FIGS. 1 to 5. The card edge connector of the first embodiment includes a harness-side connector H and a board-side connector P as shown in FIG. 1.

(Board-Side Connector P)

Figure 1:
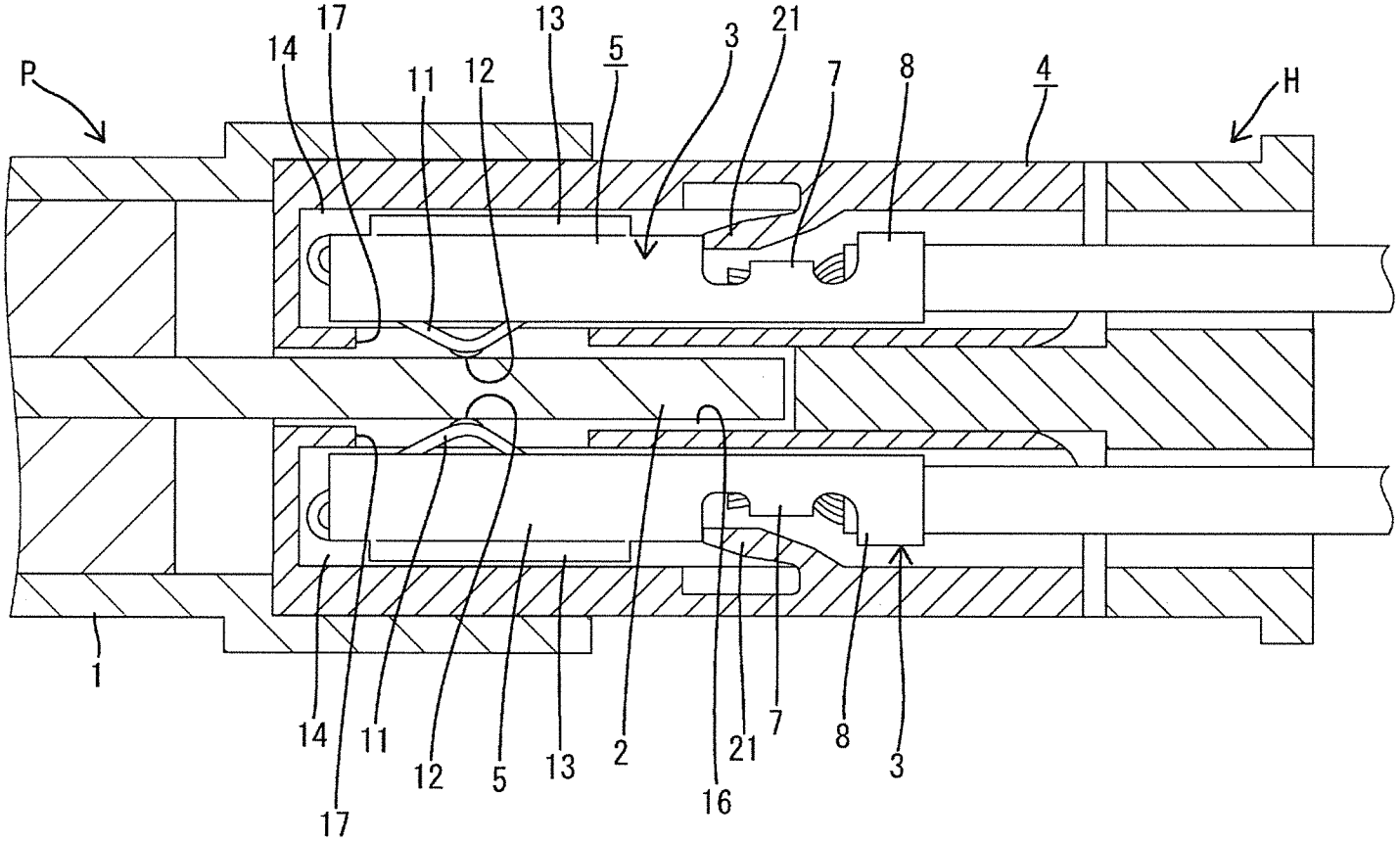
FIG. 1 is a side view in section showing a state where a harness-side connector and a board-side connector are connected to connect terminal fittings and a circuit board in a first embodiment.

As shown in FIG. 1, the board-side connector P is an integral assembly of a board-side housing 1 made of synthetic resin and a circuit board 2 formed by molding. The circuit board 2 is mounted partially in a cantilever manner in the board-side housing 1 and is mounted to project farther forward from the front end of the board-side housing 1.

A multitude of conductive paths (not shown) are formed on both sides (both upper and lower surfaces) of the circuit board 2 by printing. When the board-side connector P and the harness-side connector H are properly connected, terminal fittings 3 to be described later and the conductive paths corresponding thereto are connected.

The circuit board 2 is made of a glass epoxy resin material. A linear expansion coefficient of the glass epoxy resin material is roughly 10 to 15 ppm/° C. as described above.

(Terminal Fittings 3)

Figure 2:
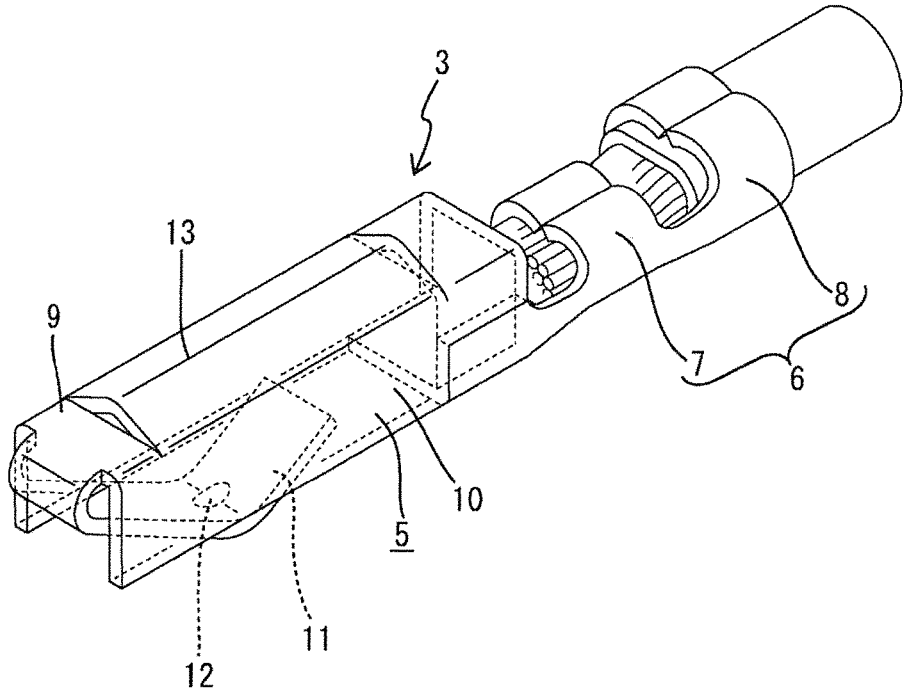
FIG. 2 is a perspective view of the terminal fitting viewed from below.
Figure 3:
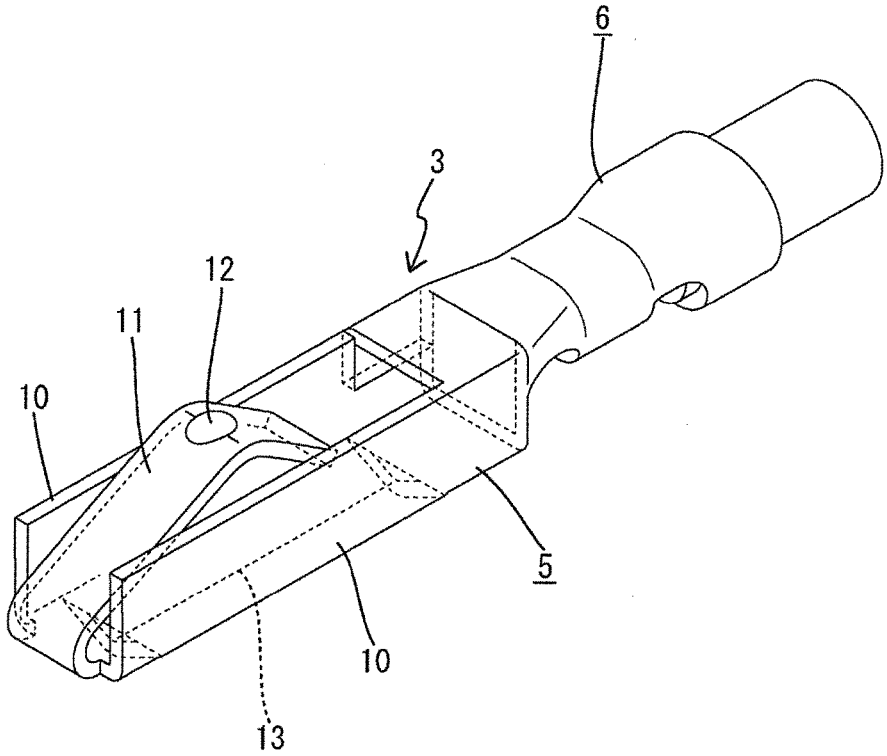
FIG. 3 is a perspective view of the terminal fitting viewed from above.

The terminal fittings 3 are accommodated in a plurality of cavities formed in a harness-side housing 4. As shown in FIGS. 2 and 3, the terminal fitting 3 is formed by bending a thin conductive metal material, a body 5 is formed in a substantially front half and a wire connecting portion 6 is formed in a substantially rear half. The wire connecting portion 6 is composed of a wire barrel 7 disposed at a position near the body portion 5 and to be crimped to a core of a wire and an insulation barrel 8 disposed at a position behind the wire barrel 7 and to be crimped to a coating of the wire.

The body 5 is in the form of a gutter composed of a bottom wall 9 and a pair of side walls 10 rising from opposite widthwise sides of the bottom wall 9, and open in a front-rear direction (longitudinal direction) and toward an upper side shown in FIG. 3. A resilient tongue 11 is disposed inside the body 5. The resilient tongue 11 is cantilevered rearward from the front end edge of the bottom wall 9 while forming a chevron shape and folded to be located between the side walls 10. In this way, the resilient tongue 11 is deflectable and deformable in a vertical direction.

As shown in FIG. 3, a top part of the resilient tongue 11 is formed to project outward from bent end edges of the side walls 10 of the body 5, and constantly is held in a state projecting from the side walls 10 both when the resilient tongue 11 is in a natural state and when the resilient tongue 11 is connected to the circuit board 2. Further, a contact portion 12 is provided on the top part of the resilient tongue 11 and is configured to resiliently contact a corresponding conductive path of the circuit board 2. The top part of the resilient tongue 11 is struck to project up, thereby forming the substantially hemispherically projecting contact portion 12.

Figure 4:
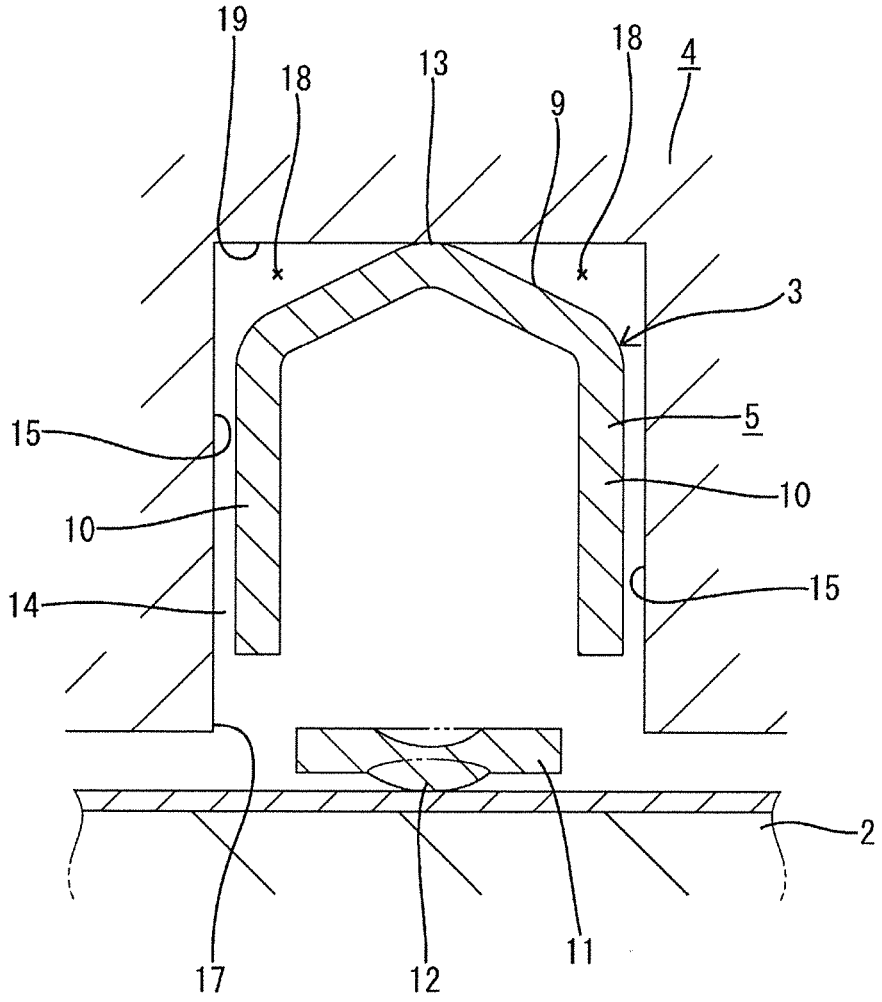
FIG. 4 is a front view in section showing a state where the terminal fitting is accommodated in a cavity and there is no thermal expansion difference between the circuit board and a harness-side housing.
Figure 5:
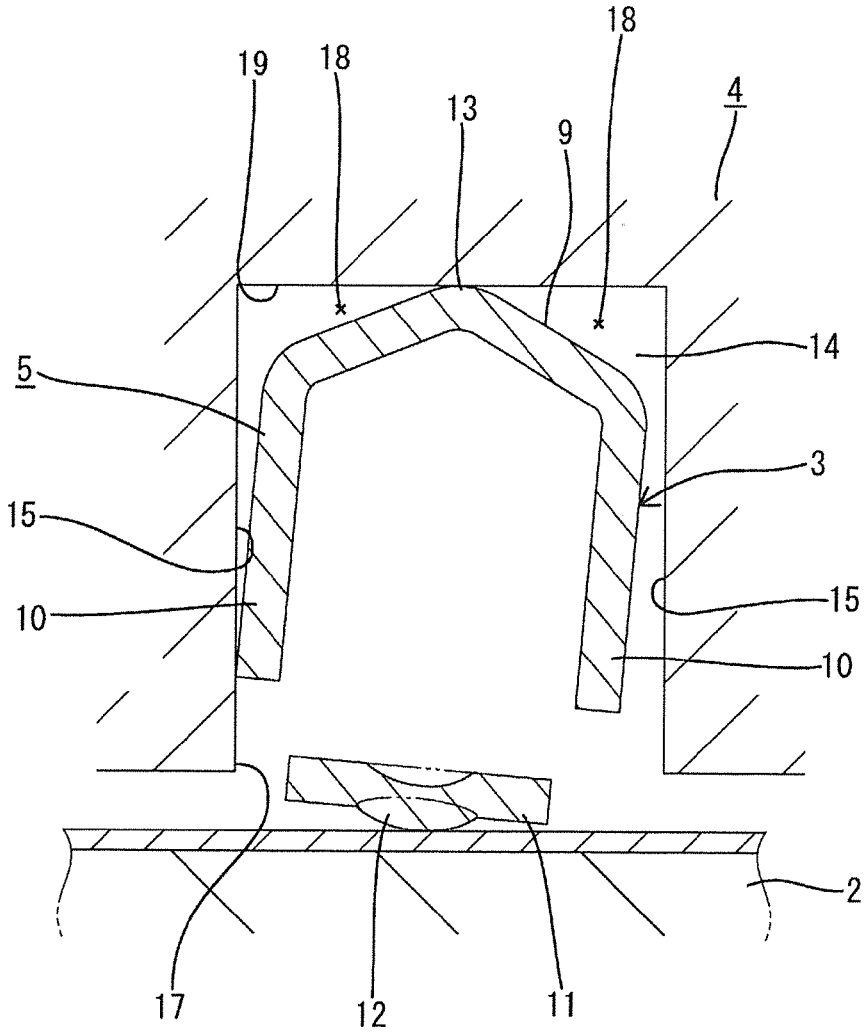
FIG. 5 is a front view in section showing a state where the terminal fitting pivots due to a thermal expansion difference.

On the other hand, as shown in FIGS. 4 and 5, in a state where the board-side connector P and the harness-side connector H are properly connected, the contact portion 12 and the circuit board 2 are resiliently in contact and the body 5 is pushed up by the action of a resilient reaction force of the resilient tongue 11 to press a part (abutting part) of the bottom wall 9 against an inner wall (ceiling wall 19) of the cavity 14. In the case of the first embodiment, this abutting part is formed by bending substantially the entire bottom wall 9 into a chevron shape such that a widthwise central part (position corresponding to and substantially right above the contact portion 12) of the bottom wall 9 becomes a top edge as shown in FIG. 2. The top edge constitutes a projecting edge 13 continuous in the longitudinal direction.

(Harness-Side Connector H)

The harness-side connector H includes the harness-side housing 4 and the terminal fittings 3 described above. The terminal fittings 3 are accommodated back-to-back in two upper and lower stages inside the harness-side housing 4. Further, the respective terminal fittings 3 are accommodated side by side at a constant interval in a width direction (depth direction perpendicular to the plane of FIG. 1).

(Harness-Side Housing 4)

The harness-side housing 4 is provided with the cavities 14 for accommodating the terminal fittings 3. A locking lance 21 is formed inside each cavity 14 and retains the terminal fitting 3 by locking the rear end of the body 5 of the terminal fitting 3. Note that, as shown in FIG. 4, an outer width of the body 5 of the terminal fitting 3 is set to be sufficiently smaller than a width between both lateral walls 15 in the cavity 14. Thus, when the terminal fitting 3 is accommodated in a proper posture in the cavity 14, clearances enabling the terminal fitting 3 to pivot in a predetermined angle range in the cavity 14 are secured between the side walls 10 of the body 5 of the terminal fitting 3 and the corresponding lateral walls 15 of the cavity 14.

The harness-side housing 4 is, for example, integrally formed of a PBT resin material. A thermal expansion coefficient of the PBT resin material is roughly 100 ppm/° C. as described above. As shown in FIG. 1, in the harness-side housing 4, a board accommodation space 16 is formed along the width direction to have a predetermined depth between rows of the cavities 14 in the upper and lower stages and can receive a tip part of the circuit board 2. Communication holes 17 are open in front end parts of the respective cavities 14 in the upper and lower stages to communicate with the board accommodation space 16. When the terminal fitting 3 is accommodated properly in the cavity 14, the contact portion 12 of the terminal fitting 3 project into the board accommodation space 16 via the communication hole 17.

Further, in the state where the harness-side connector H and the board-side connector P are connected properly, the projecting edge 13 serving as the abutting part is pressed against the ceiling wall 19 of the cavity 14 as described above as the resilient tongue 11 resiliently contacts the circuit board 2. Thus, as shown in FIGS. 4 and 5, clearances (escaping portions 18) are secured between the body 5 and the ceiling wall 19 of the cavity 14 on both sides across the projecting edge 13 in the width direction. This enables the terminal fitting 3 to pivot clockwise or counterclockwise in the predetermined angle range about a resilient abutting part of the contact portion 12 and the circuit board 2 as shown in FIG. 5.

Next, functions and effects of the first embodiment configured as described above are described. When the harness-side connector H and the board-side connector P are connected properly, the contact portion 12 of each terminal fitting 3 resiliently contacts the corresponding conductive path of the circuit board 2. Along with this, the terminal fitting 3 is lifted up by a resilient reaction force of the resilient tongue 11 and the projecting edge 13 is pressed against the inner wall (ceiling wall 19) of the cavity 14.

If the card edge connector is in a high-temperature environment at this time, the circuit board 2 and the harness-side housing 4 elongate in the width direction (lateral direction) in FIG. 4 (also elongate in the depth direction, but no issue is made of it here). There is a relatively large thermal expansion difference between the circuit board 2 and the harness-side housing 4, as described above. Thus, a larger shift force may be generated in the width direction at a part where the projecting edge 13 and the ceiling wall 19 of the cavity 14 are in contact than at the resilient abutting part of the contact portion 12 and the circuit board 2. Thus, the terminal fitting 3 acts relatively with the resilient abutting part of the contact portion 12 and the circuit board 2 serving as a fixed point and the abutting part of the projecting edge 13 and the ceiling wall 19 of the cavity 14 serving as a movable point enabling a movement in the width direction, and entirely takes a pivoted posture as shown in FIG. 5 with the resilient abutting part of the contact portion 12 and the circuit board 2 serving as a pivot point.

In this case, the contact portion 12 is held in contact with the corresponding conductive path of the circuit board 2 and a contact position thereof does not vary. Thus, the abrasion of the contact portion 12 accompanying a sliding movement of the contact portion 12 as before can be avoided.

However, when a pivot angle of the terminal fitting 3 reaches a certain angle, one side wall 10 of the body 5 of the terminal fitting 3 contacts the lateral wall 15 in the cavity 14 as shown in FIG. 5. Therefore, the terminal fitting 3 does not pivot excessively.

In the first embodiment, the escaping portions 18 are arranged uniformly in the lateral direction by disposing the projecting edge 13 in the widthwise central part of the bottom wall 9 of the terminal fitting 3. Thus, the terminal fitting 3 is allowed to pivot equally to both left and right sides. Further, since the projecting edge 13 has a pointed tip, a contact area with the ceiling wall 19 of the cavity 14 is small. Thus, a transition to a pivoted posture can be made smoothly. Further, since the projecting edge 13 is formed only on the terminal fitting 3, there is also such an effect that the harness-side housing 4 having an existing structure can be used as it is.

Figure 6:
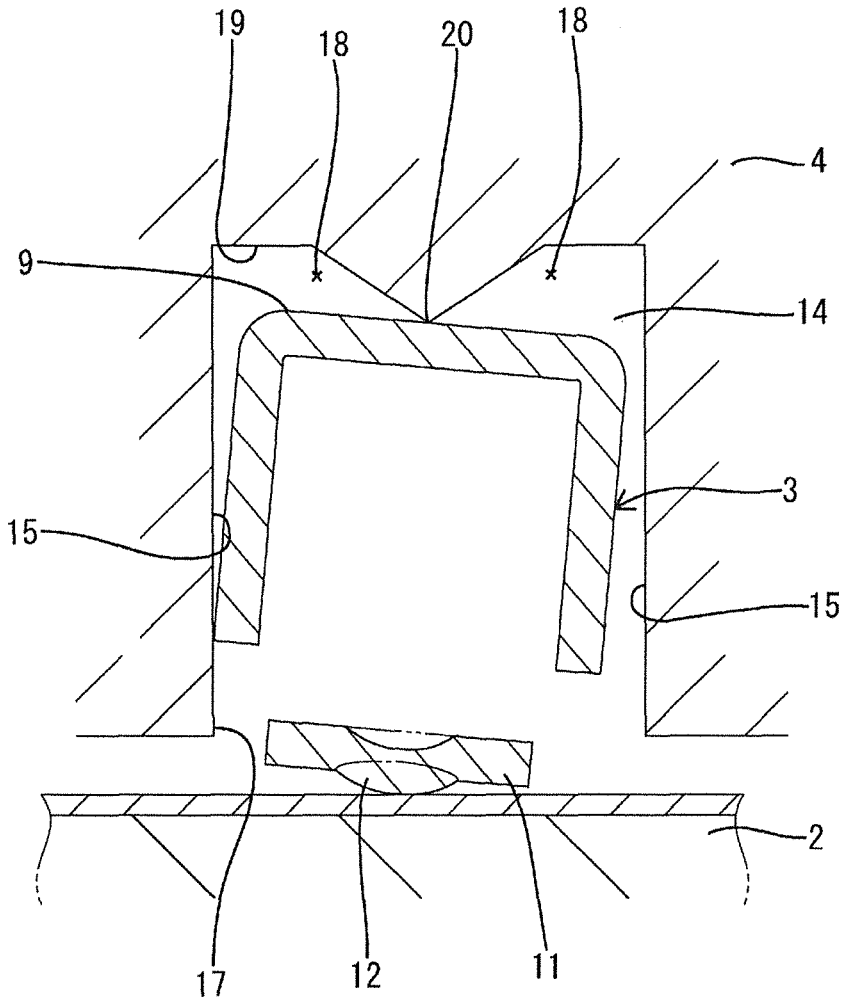
FIG. 6 is a front view in section showing a state where a terminal fitting pivots in a second embodiment.

FIG. 6 shows a second embodiment of the invention. Although the projecting edge 13 serving as the abutting part is formed on the terminal fitting 3 in the first embodiment, a ridge 20 is formed on an inner wall (ceiling wall 19) of a cavity 14 and the tip thereof comes into contact with a bottom wall of a terminal fitting 3 in the second embodiment. The ridge 20 is formed along a longitudinal direction (depth direction in FIG. 6) in a widthwise central part of the cavity 14. The ridge 20 is formed such that a base end part is wide and the tip is pointed. Thus, an abutting part on the terminal fitting 3 is a part of the bottom wall of the terminal fitting with which the ridge is held is contact. In this way, escaping portions 18 for allowing the terminal fitting 3 to pivot are formed at both sides of this abutting part in a width direction.

A card edge connector of the second embodiment is configured as described above and the other configuration is as in the first embodiment and, hence, exhibits similar functions and effects. In addition, in the case of the second embodiment, there is obtained an effect that the terminal fitting 3 having an existing structure can be used as it is.

Figure 7:
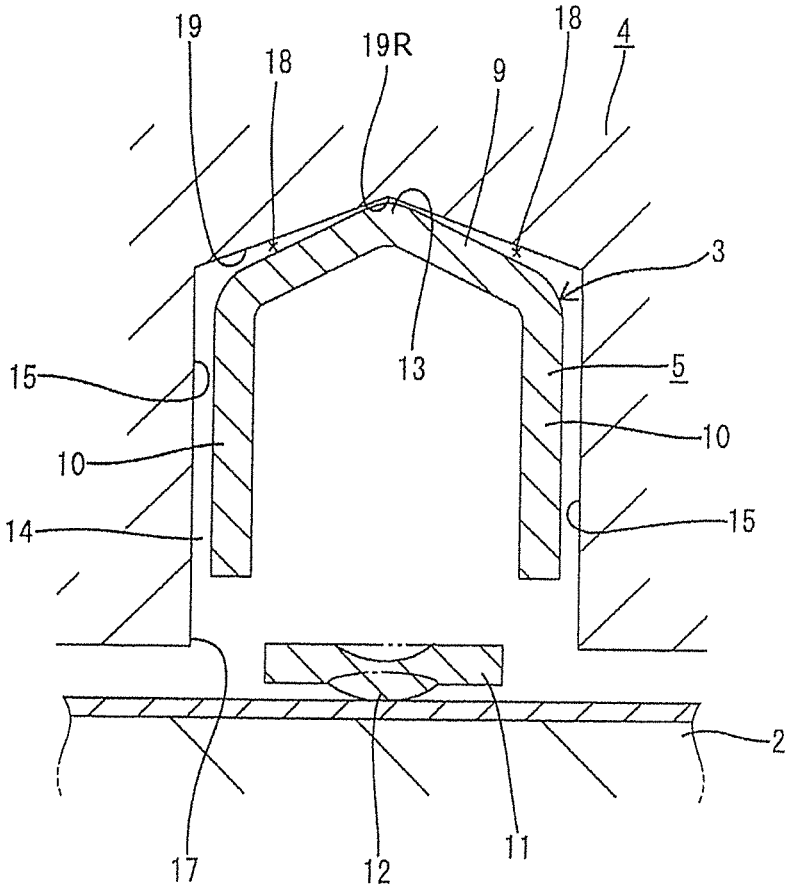
FIG. 7 is a view, corresponding to FIG. 4, in a third embodiment.

FIG. 7 shows a third embodiment of the invention. In the third embodiment, a terminal fitting 3 is formed with a projecting edge 13 (abutting part) projecting toward a ceiling wall 19, whereas a recessed edge 19R having a chevron cross-section is formed along a longitudinal direction in a widthwise center of the ceiling wall 19 in a cavity 14. In a state where a harness-side connector and a board-side connector H, P are properly connected, the projecting edge 13 and the recessed edge 30 are held in contact along a front-rear direction (longitudinal direction). Further, both sides of a bottom wall 9 of the terminal fitting 3 across the projecting edge 13 have a steeper gradient than both sides of the ceiling wall 19 of the cavity 14 across the recessed edge 19R. Due to this gradient difference, escaping portions 18 for allowing the terminal fitting 3 to pivot are respectively formed on both sides in a width direction across a part where the projecting edge 13 and the recessed edge 30 are in contact as in the first and second embodiments.

A card edge connector of the third embodiment is configured as described above and the other configuration is as in the first and second embodiments and, hence, exhibits similar functions and effects. In addition, since the projecting edge 13 and the recessed edge 19R are fit along the longitudinal direction in the third embodiment, there is also exhibited an effect that the entire terminal fitting 3 can be positioned in the width direction in the cavity 14.

Figure 8:
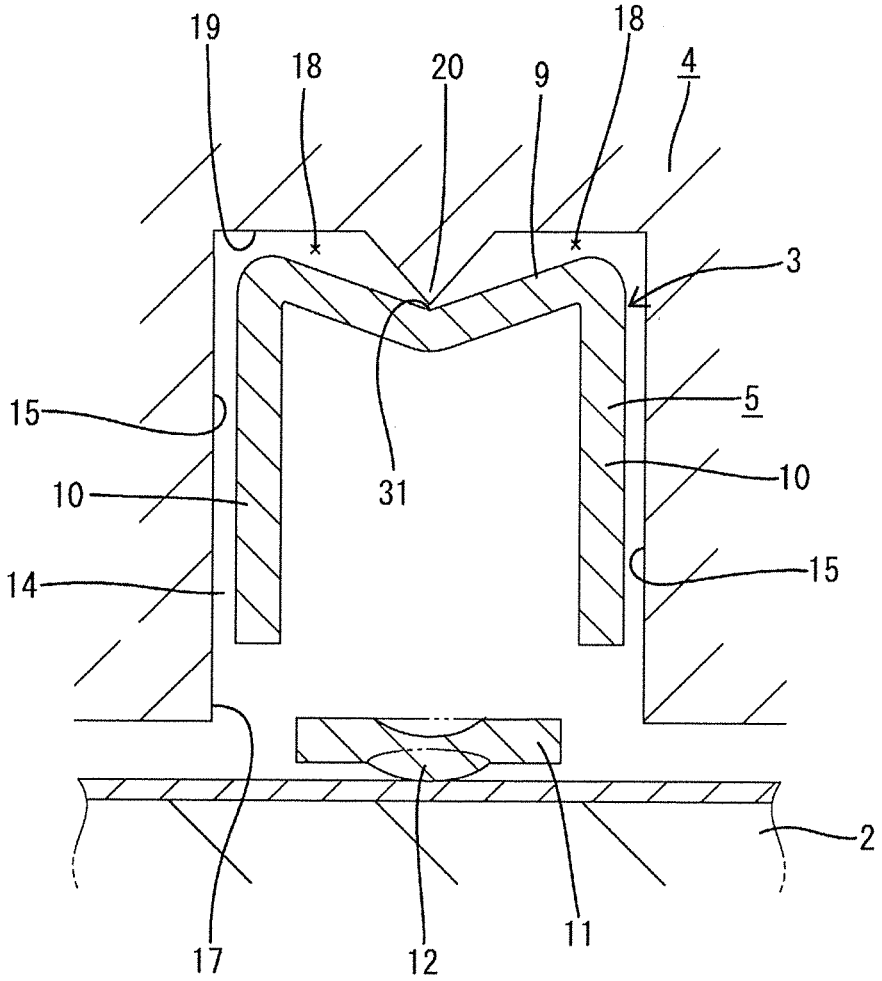
FIG. 8 is a view, corresponding to FIG. 4, in a fourth embodiment.
Figure 9A:
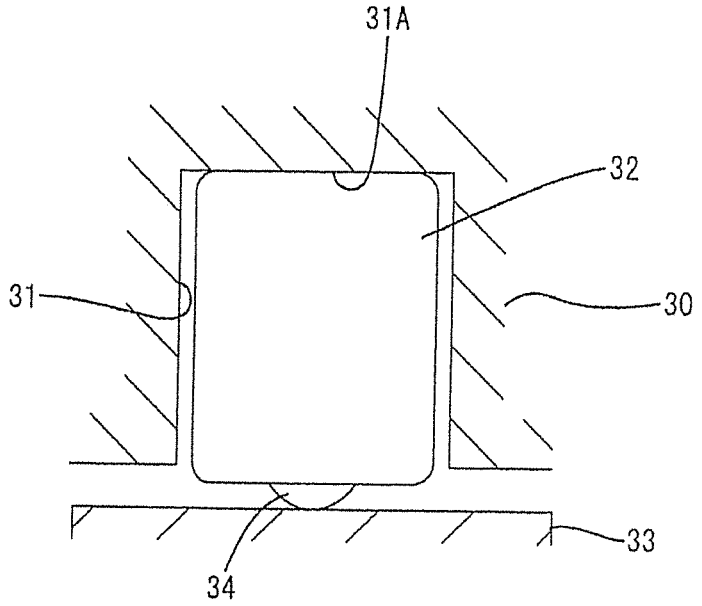
FIG. 9(A) is a front view in section showing a state where a prior art terminal fitting is properly accommodated in a cavity.
Figure 9B:
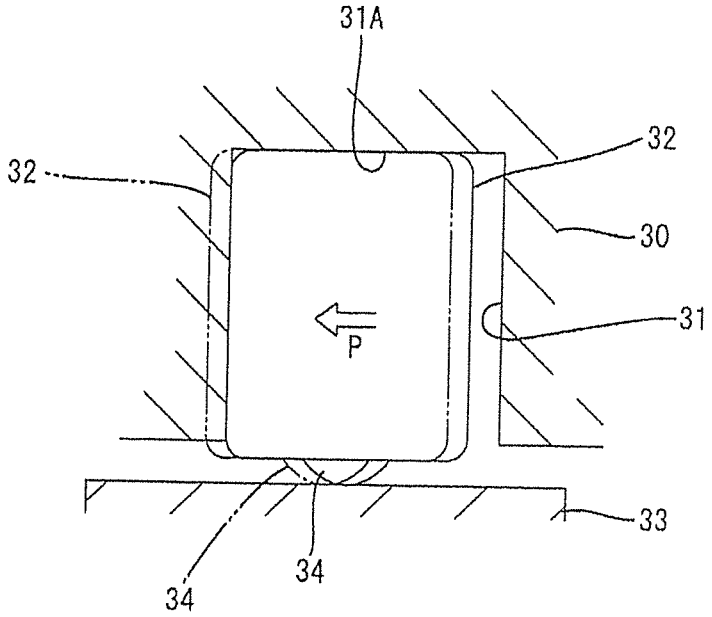
FIG. 9(B) is a front view in section showing a state where the entire terminal fitting of FIG. 9(A) is shifted due to a thermal expansion difference.

FIG. 8 shows a fourth embodiment of the invention. In the fourth embodiment, a ridge 20 is formed on a ceiling wall 19 of a cavity 14, whereas a recessed groove 31 is formed in a widthwise central part of a bottom wall 9 of a terminal fitting 30. Both side surfaces of the recessed groove 31 are recessed straight toward a most recessed part (trough part: abutting part) and the trough part extends straight along a front-rear direction (longitudinal direction). In a state where a harness-side connector and a board-side connector H, P are properly connected, the ridge 20 and the trough part of the recessed groove 31 are held in contact along the front-rear direction. Further, the both side surfaces constituting the recessed groove 31 have a gentler gradient than both side surfaces constituting the ridge 20. Due to this gradient difference, escaping portions 18 are formed at both sides of the trough part of the recessed groove 31 serving as an abutting part in the width direction, and allow the terminal fitting 3 to pivot.

A card edge connector of the fourth embodiment is configured as described above and the other configuration is as in the first to third embodiments and, hence, exhibits similar functions and effects. In addition, since the ridge 20 and the trough part of the recessed groove 31 are fit along the longitudinal direction in the fourth embodiment, there is also exhibited an effect that the entire terminal fitting 3 can be positioned in the width direction in the cavity 14.

The invention is not limited to the above described and illustrated embodiments. For example, the following embodiments are also included in the technical scope of the present invention.

Although the projecting edge 13 of the terminal fitting 3 is continuously formed along the longitudinal direction of the body 5 in the above first embodiment, a plurality of projecting edges may be intermittently formed. In such a case, the projecting edges 13 may be formed by locally striking the bottom wall rather than by bending the bottom wall as in the first embodiment.

Although the body 5 of the terminal fitting 3 has no front wall (wall covering a folded part of the resilient tongue 11) in the above embodiments, the front wall may be formed.

LIST OF REFERENCE SIGNS

1 . . . board-side housing
2 . . . circuit board
3 . . . terminal fitting
4 . . . harness-side housing
5 . . . body
11 . . . resilient tongue
12 . . . contact portion
13 . . . projecting edge
14 . . . cavity
18 . . . escaping portion
19 . . . ceiling wall (inner wall of cavity)
20 . . . ridge
30 . . . recessed edge
31 . . . recessed groove

The invention claimed is:

1. A card edge connector, comprising:

terminal fittings each including a body and a resilient tongue continuously formed in the body, the resilient tongue having a contact portion, the contact portion being resiliently deflectable while projecting outward from the body;

a harness-side connector including a harness-side housing, the terminal fittings being accommodated in a plurality of cavities formed side by side in the harness-side housing; and a board-side connector including a board-side housing, a circuit board being mounted in the board-side housing;

the contact portion resiliently contacting the circuit board when the harness-side housing is connected to the board-side housing, whereby a part of the body on an opposite side in a deflection direction of the resilient tongue serves as an abutting part to be pressed into contact with an inner wall of the cavity, wherein one of the body and the inner wall of the cavity is formed with an escaping portion with respect to the inner wall of the cavity formed laterally to the abutting part in an arrangement direction of the cavities such that the terminal fitting pivots with the resiliently deflectable contact portion and the circuit board serving as a supporting point when there is a thermal expansion difference in the arrangement direction of the cavities between the circuit board and the harness-side housing.

2. The card edge connector of claim 1, wherein the abutting part is disposed in a central part of the body in the arrangement direction of the cavities and the escaping portions are disposed on both sides across the abutting part.

3. The card edge connector of claim 2, wherein a projecting edge having a pointed tip and serving as the abutting part configured to resiliently contact the inner wall of the cavity along a direction perpendicular to the arrangement direction of the cavities is formed to project on the body of the terminal fitting.

4. The card edge connector of claim 2, wherein a ridge extending along a direction perpendicular to the arrangement direction of the cavities and having a pointed tip is formed to project on the inner wall of the cavity, and the tip of the ridge comes into contact with the terminal fitting at the abutting part.

5. The card edge connector of claim 3, wherein a recessed edge having a chevron cross-section, recessed with a gentler gradient than side surfaces constituting the projecting edge and configured to come into contact with the projecting edge along a longitudinal direction is formed on the inner wall of the cavity.

6. The card edge connector of claim 4, wherein a recessed groove recessed with a gentler gradient than side surfaces constituting the ridge and having a trough part configured to come into contact with the ridge along a longitudinal direction is formed on the body of the terminal fitting.

7. The card edge connector of claim 1, wherein a projecting edge having a pointed tip and serving as the abutting part configured to resiliently contact the inner wall of the cavity along a direction perpendicular to the arrangement direction of the cavities is formed to project on the body of the terminal fitting.

8. The card edge connector of claim 1, wherein a ridge extending along a direction perpendicular to the arrangement direction of the cavities and having a pointed tip is formed to project on the inner wall of the cavity, and the tip of the ridge comes into contact with the terminal fitting at the abutting part.

* * * * *